US012006681B1

(12) United States Patent
Carpinetti

(10) Patent No.: US 12,006,681 B1
(45) Date of Patent: Jun. 11, 2024

(54) BLACK DUCK II—BUILDING SYSTEM WITH HEAT INSULATION AND A PASSAGEWAY FOR FIRE RETARDANT GAS

(71) Applicant: David J. Carpinetti, West Brookfield, MA (US)

(72) Inventor: David J. Carpinetti, West Brookfield, MA (US)

( * ) Notice: Subject to any disclaimer, the term of this patent is extended or adjusted under 35 U.S.C. 154(b) by 126 days.

(21) Appl. No.: 17/300,038

(22) Filed: Feb. 22, 2021

Related U.S. Application Data

(60) Provisional application No. 63/100,224, filed on Mar. 3, 2020.

(51) Int. Cl.
*E04B 1/80* (2006.01)
*E04B 1/94* (2006.01)
*E04C 2/292* (2006.01)

(52) U.S. Cl.
CPC ..... *E04B 1/806* (2013.01); *E04B 1/942* (2013.01); *E04C 2/292* (2013.01)

(58) Field of Classification Search
CPC ..... E04B 1/806; E04B 1/942; E04B 1/943; E04B 2/7409; E04B 2/741; F24F 13/0227; E04C 2/292
See application file for complete search history.

(56) References Cited

U.S. PATENT DOCUMENTS 2,747,651 A * 5/1956 Lighter ..... E04B 1/806 156/196
2,754,235 A * 7/1956 Wesner ..... E04B 1/806 52/576
3,548,930 A * 12/1970 Byrd ..... B64G 1/58 244/1 R
5,706,620 A * 1/1998 De Zen ..... E04B 7/20 52/270
5,729,944 A * 3/1998 De Zen ..... B29C 48/09 52/439
5,953,880 A * 9/1999 De Zen ..... E04B 1/12 405/257
6,231,704 B1 * 5/2001 Carpinetti ..... F24F 13/02 285/284.1
8,667,995 B1 * 3/2014 Fanelli ..... F24F 13/0245 138/112

FOREIGN PATENT DOCUMENTS

WO WO-0173237 A1 * 10/2001 ..... E04B 1/942

* cited by examiner

*Primary Examiner* — Christine T Cajilig
(74) *Attorney, Agent, or Firm* — Frank L. Kubler

(57) ABSTRACT

A building panel system includes a number of panels, each panel being formed of a first panel sheet and a second panel sheet parallel to and spaced apart from the first panel sheet, and a sheet interconnecting structure extending between and structurally joining together the first panel sheet and the second panel sheet; at least one panel splicing structure capable of passing a gaseous fire retardant from the interior of one of the panels to the next panel, such that at least several panels of the system are in fluid communication with each other.

14 Claims, 6 Drawing Sheets

BLACK DUCK II—BUILDING SYSTEM WITH HEAT INSULATION AND A PASSAGEWAY FOR FIRE RETARDANT GAS

FILING HISTORY

This application continues from provisional patent application Ser. No. 63/100,224 filed on Mar. 3, 2020.

BACKGROUND OF THE INVENTION

1. Field of the Invention

The present invention relates generally to the field of building construction. More specifically the present invention relates to a building panel system which provides heat insulation and defines a continuous flow path, referred to herein as a system passageway, through which a gaseous fire retardant can be delivered to extinguish or contain a fire. The system includes panels of any desired shape to form external or internal building structures such as building walls and partitions, portions of structural walls and walls of ducts, and panel splicing connectors for joining each panel end to end to the next.

Each panel is formed of a first panel sheet and a second panel sheet parallel to and spaced apart from the first panel sheet, and a sheet interconnecting structure extending between and structurally joining together the first and second panel sheets. The panel splicing structures are perforated to be capable of passing the gaseous fire retardant from the interior of one panel to the next panel, so that the entire system is in fluid communication. The panel sheets and panel splicing structures may be formed of any suitable durable material, but preferably are formed of ABS plastic. Gas release structures, such as ports or nozzles, are provided in the panels and are in fluid communication with the system passageway, at selected locations. The internal gap between the first and second panel sheets provides a layer of air within each panel which is a highly effective heat insulator. The system passageway, defined by the system-wide fluid communication through the interconnected panel internal gaps, permits a selected gas such as carbon dioxide to be delivered, such as from gas cylinders, into at least one entry coupler to flow throughout the system, build gas pressure, and be discharged through the gas release structures, a target area. A series of nozzles, for example, may direct the gas from a system passageway within the foundation at a high flow rate along and against the outside surface of a building wall to prevent the wall from catching fire and to extinguish any fire which has begun.

The panel system may form a duct such as for an air conditioning system. In this instance, the first panel sheet defines an interior tube, and the second panel sheet defines an exterior tube containing and coaxial with the interior tube and sized relative to the interior tube to be spaced radially apart from the duct interior tube, thereby defining the panel internal gap. The tubes may be of round, square or any other desired cross-sectional shape. The sheet interconnecting structure preferably includes a series of radial fins extending between and joined to the first and second panels and extending parallel to the axis of the tubes so that the fins do not obstruct axial gas flow through the gap between the tubes. The panel splicing structures each preferably take the form of a connecting ring having an outer tube segment sized to slide snugly over the duct exterior tube outward surface, and an inner tube segment sized to slide snugly over the duct interior tube segment inward surface, and a perforated tube segment connecting flange extending between and connecting the inner and outer tube segments spaced inwardly from the opposing ends of the tube segments. Perforations in the tube segment connecting flange preferably are a circumferential series of relatively large holes in the flange. As a result of this construction, the opposing ends of adjacent duct segments fit snugly into the opposing sides of the connecting ring to sealingly interconnect the duct segments, and a glue or adhesive is optionally provided on the surfaces where the connecting ring overlaps and abuts the duct segment interior and exterior tubes. The use of an adhesive enhances both sealing and structural strength of the duct as a whole. When assembled, the central space within the series of interior tubes of the resulting duct forms an air conditioning system flow path, while the annular space between the collective interior and exterior tubes, also referred to as gaps, define part or all of the present system passageway.

The plastic sheets forming the system panels also function as a barrier to the entry of insects by providing a plastic encased building, such as the illustrated home.

2. Objects of the Invention

It is thus an object of the present invention to provide building panel system which has a collective internal system passageway that can receive a gaseous substance such as a fire retardant and deliver it internally throughout the system to any desired discharge point or points, the system passageway being formed of hollow areas within each system panel and openings through panel splicing structures connecting the panels end to end.

It is another object of the present invention to provide such a panel system in which the internal passageway is defined by a void in each panel which provides heat insulating air layer when not in use for gaseous substance delivery.

It is still another object of the present invention to provide such a panel system in which the panels making up the system can be shaped to define a variety of structures including building walls, partitions and walls of ducts.

It is finally an object of the present invention to provide such a panel system which is light weight, easy to assemble, can shield a building from insects, and is inexpensive,

SUMMARY OF THE INVENTION

The present invention accomplishes the above-stated objectives, as well as others, as may be determined by a fair reading and interpretation of the entire specification.

A building panel system is provided generally including a number of panels, each panel being formed of a first panel sheet and a second panel sheet parallel to and spaced apart from the first panel sheet, and a sheet interconnecting structure extending between and structurally joining together the first panel sheet and the second panel sheet; at least one panel splicing structure capable of passing a gaseous fire retardant from the interior of one of the panels to the next panel, such that at least several panels of the system are in fluid communication with each other.

A building panel system is further provided for constructing internal and external building structures and providing heat insulation and defining a continuous internal flow path for fire retardant, the building panel system including a number of panels, each of the panels including a first panel sheet and a second panel sheet generally parallel to and spaced apart from the first panel sheet defining a panel internal gap and a sheet interconnecting structure extending between and structurally joining together the first panel sheet and the second panel sheet; and a number of panel splicing structures, each of the splicing structures being perforated for passing gaseous fire retardant from the interior of one panel to the interior of an adjacent panel, so that the all parts of the system are in fluid communication with each other and collectively define a system passageway, and so that the panel internal gap between the first panel sheet and the second panel sheet provides a layer of air within each such panel for heat insulation, and the system passageway defined by the system-wide fluid communication through interconnected panel internal gaps permits a selected gas to be delivered into at least one system passageway entry point to flow throughout the system.

The building panel system preferably additionally includes a panel peripheral strip along the upper and lower ends of the system panels to contain gas flowing through the system passageway. The panel sheets and the panel splicing structures preferably are formed of ABS plastic.

The building panel system preferably additionally includes a number of gas release structures along at least one of the panels and in fluid communication with the system passageway, so that as gas enters the system passageway the gas builds pressure and is discharged through the gas release structures over a target area. The gas release structures preferably include a series of nozzles for directing the gas from the system passageway at a high flow rate along and against an outside surface of a building wall to prevent the wall from catching fire and to extinguish any fire which has begun. The gas release structures optionally are one of ports and nozzles.

The panel system optionally forms a duct, a first panel sheet being looped to form a duct interior tube and a second panel sheet being looped to form a duct exterior tube containing and generally coaxial with the interior tube and sized relative to the interior tube to be spaced radially apart from the duct interior tube, thereby defining an annular panel internal gap. The sheet interconnecting structure optionally includes a series of radial fins extending between and joined to the first and second panels and extending generally parallel to the substantially common axis of the tubes so that the fins do not obstruct axial gas flow through the annular panel internal gap between the tubes. The panel splicing structures alternatively may each include a connecting ring having an outer tube segment sized to slide closely over the duct exterior tube outward surface, and an inner tube segment sized to slide closely over the duct interior tube inward surface, and a perforated tube segment connecting flange extending between and connecting the inner and outer tube segments spaced inwardly from the opposing ends of the tube segments; so that opposing ends of adjacent duct segments fit snugly into the opposing sides of the connecting ring to interconnect the duct segments; and so that the central space within the series of duct interior tubes of the resulting duct forms an air conditioning system flow path, while the annular panel internal gap between the collective interior and exterior tubes define at least part of the system passageway.

The building panel system optionally additionally includes a duct transition joint for connecting an end of a square duct to an end of a round duct, the duct transition joint including the joint exterior and interior tubes configured so that their cross-sectional shapes progressively change from round to square and the transition joint has a joint square end and a joint round end. Each sheet interconnecting structure optionally includes a radial connecting flange, set inwardly from either end of the transition joint and having gas passing holes, and the exterior tube is sized to fit closely over the outward surface of the exterior tube of the adjacent round or square duct segment, and the interior tube is sized to fit snugly along the inward surface of the interior tube. The building panel system optionally yet additionally includes a take-off boot, the flange of which fits snugly inside the inward surface The interconnecting structures optionally each include connecting legs protruding outwardly from one panel sheet and meeting and being connected to the other panel sheet, so that gas can flow through lateral spaces between connecting legs. The legs optionally protrude from a grid of crossing and interconnected grid flanges to add structural strength to the panel.

The system panels optionally form a foundation insulation wall portion abutting a structural wall portion, and a series of the panels is affixed along an outer surface of a foundation structural wall portion below ground level, and gas release structures protrude upwardly from the series of the system panels; so that fire retardant can be delivered into the system passageway, and the gas release structures direct gas upwardly close to and generally parallel to the outer face of the above ground building wall.

The panel splicing structures for planar system panels preferably are plastic I-beams having opposing and spaced apart gripping flanges to slide over outward surfaces of the panel sheets and a connecting flange with a series of gaseous substance passing holes. The panels may be interconnected to define one of: a storage shed, a shower stall, and a heat insulated box.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
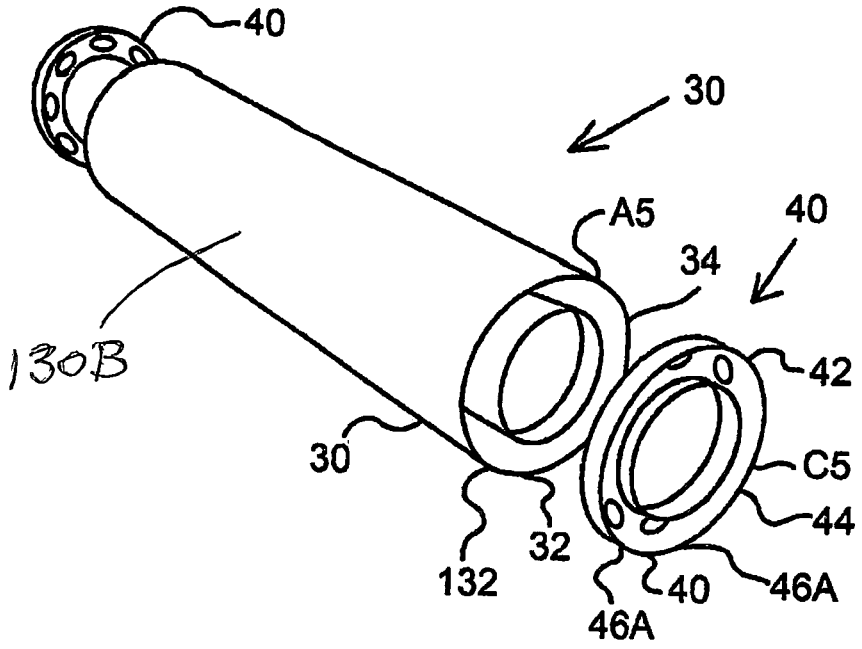
FIG. 1 is a perspective view of a circular system duct formed according to the present building panel system of a system panel looped into a tubular configuration, having coaxial interior and exterior tubes sized in diameter to have a heat insulating air gap between them and radial tube interconnection structures, and a duct splicing structure for connecting one such tube to another end to end for form a continuous duct while defining a continuous gap also referred to as a system passageway between and through the connected circular ducts and the duct splicing structure.
Figure 2:
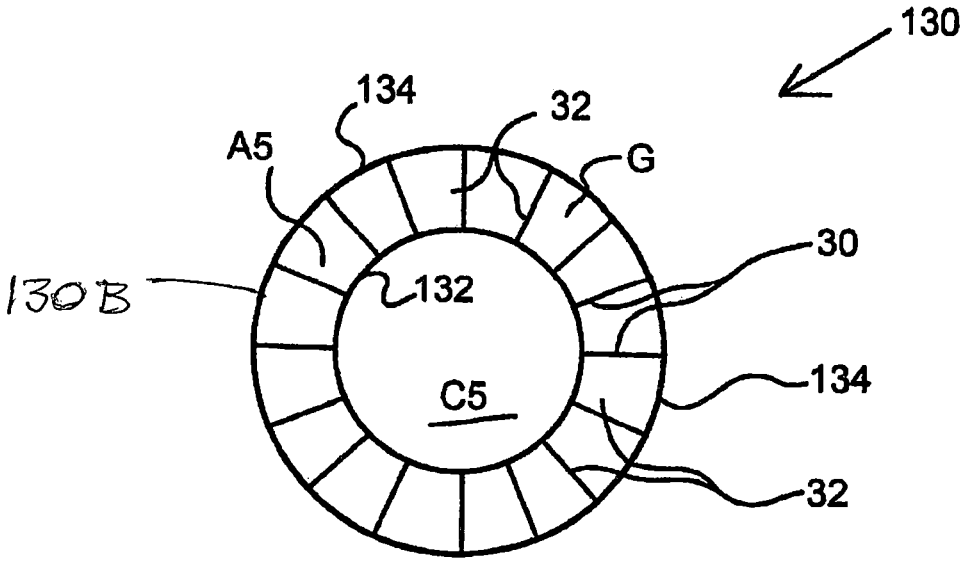
FIG. 2 is an end view of the circular duct of FIG. 1.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to attached FIGS. 1-11, building panel system 10 is disclosed which provides heat insulation and defines a continuous internal flow path, referred to herein as the system passageway 12, through which a gaseous fire retardant can be delivered to extinguish or contain a fire. The system 10 includes panels 20 of any desired shape to form external or internal building structures such as building walls and partitions insulating wall portions abutting a structural wall, including foundations and walls 20 of ducts 130, and panel splicing connectors 40 for joining each panel 20 end to end to the next.

Each panel 20 is formed of a first panel sheet 22 and a second panel sheet 24 parallel to and spaced apart from the first panel sheet 22, and a sheet interconnecting structure 30 extending between and structurally joining together the first and second panel sheets 22 and 24. The panel splicing structures 40 are perforated to be capable of passing the gaseous fire retardant from the interior of one panel 20 to the next panel 20, so that the all parts of system 10 are in fluid communication with each other. A panel peripheral strip 28 optionally is provided along the upper and lower ends or edges of the system panels 20 to contain gas flowing through the system passageway 12. The panel sheets 22 and 24 and the panel splicing structures 40 may be formed of any suitable durable material, but preferably are formed of ABS plastic.

Gas release structures, such as ports or nozzles, are provided along the panels 20 were desired and are in fluid communication with the system passageway 12 at selected locations. The internal gap G between the first and second panel sheets 22 and 24 provides a layer of air within each panel 20 which is a highly effective heat insulator. The system passageway 12, defined by the system-wide fluid communication through the interconnected panel internal gaps G, permits a selected gas such as carbon dioxide to be delivered, such as from gas cylinders GC, into at least one entry coupler EC to flow throughout the system 10, build gas pressure, and be discharged through the gas release structures over a target area T. A series of nozzles, for example, may direct the gas from a system passageway 12 within the foundation F at a high flow rate along and against the outside surface of a building wall W to prevent the wall W from catching fire and to extinguish any fire which has begun.

As noted, the panel system 10 may form a duct 130 such as for an air conditioning system. In this instance, the first panel sheet 22 defines a duct interior tube 132, as shown in FIG. 1, and the second panel sheet 24 defines a duct exterior tube 134 containing and coaxial with the interior tube 132 and sized relative to the interior tube 134 to be spaced radially apart from the duct interior tube 132, thereby defining an annular panel internal gap G. The interior and exterior duct tubes 132 and 134 may be of round, square or any other desired cross-sectional shape. The sheet interconnecting structure 30 preferably includes a series of radial fins 32 extending between and joined to the first and second panels 20 and extending parallel to the common axis of the tubes 132 and 134 so that the fins 32 do not obstruct axial gas flow through the gap G between the tubes 132 and 134. The panel splicing structures 40 each preferably take the form of a connecting ring 40 having an outer tube segment 42 sized to slide snugly over the duct exterior tube 134 outward surface, and an inner tube segment 44 sized to slide snugly over the duct interior tube 132 inward surface, and a perforated tube segment connecting flange 46 extending between and connecting the inner and outer tube segments 42 and 44 spaced inwardly from the opposing ends of the tube segments 42 and 44. Perforations in the tube segment connecting flange 46 preferably are a circumferential series of relatively large holes 46A in the flange 46. As a result of this construction, the opposing ends of adjacent duct 30 segments fit snugly into the opposing sides of the connecting ring 40 to sealingly interconnect the duct 130 130 segments, and a glue or adhesive is optionally provided on the surfaces where the connecting ring 40 overlaps and abuts the given duct segment interior and exterior tubes 132 and 134. The use of an adhesive enhances both sealing and structural strength of the duct 130 as a whole. When assembled, the central space CS within the series of duct interior tubes 132 of the resulting duct 130 forms an air conditioning system flow path, while the annular space AS between the collective interior and exterior tubes 132 and 134, also referred to as gaps G, define part or all of the present system passageway 12.

A duct transition joint 140 is optionally provided for connecting an end of a square duct 130A to an end of a round duct 130B. See FIG. 4. The duct transition joint 140 includes the joint exterior and interior tubes 144 and 142 respectively as described, except that their cross-sectional shapes progressively changes from round to square, so that the transition joint 140 has a joint square end 140A and a joint round end 140B. The sheet interconnecting structure 36 includes a radial connecting flange 36, similar to connecting flange 46 of the connecting ring 40, set inwardly from either end of the transition joint 140 and having gas passing holes 46A, and the exterior tube 144 preferably is sized to fit snugly over the outward surface of the exterior tube 134 of the adjacent round or square duct 130 segment, and the interior tube 142 preferably is sized to fit snugly along the inward surface of the interior tube 132. And, once again, an adhesive may be used for enhanced sealing and structural strength for the duct 130 as a whole. A take off boot 146 is provided, the flange of which fits snugly inside the inward surface of the interior tube 132.

Figure 3:
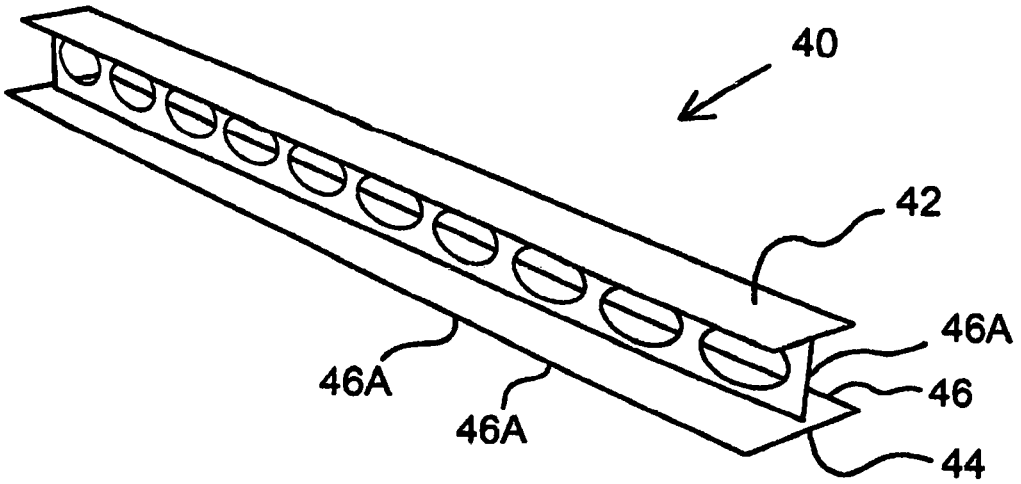
FIG. 3 is a perspective view of a panel splicing structure for connecting system panels end to end, while maintaining a continuous gap defining the system passageway through the system panels and panel splicing structure.
Figure 4:
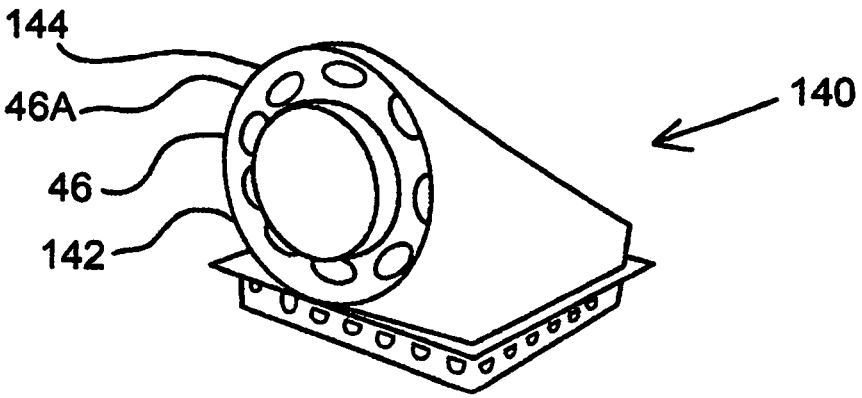
FIG. 4 is a perspective view of a duct transition joint for connecting an end of a square system duct to an end of a round system duct, having joint exterior and interior tubes sized to define an annular gap between them for connecting and placing in mutual fluid communication the gaps of two ducts joined by the duct transition joint to once again define the system passageway.
Figure 5:
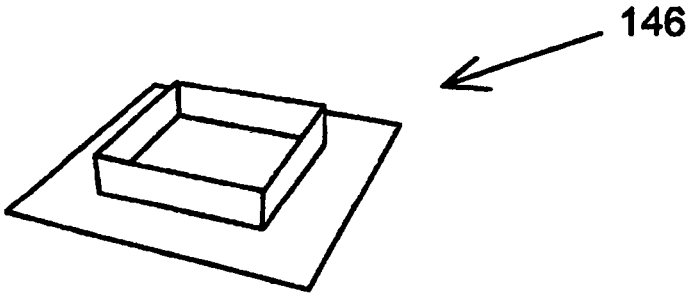
FIG. 5 is a perspective view of a system take-off boot.
Figure 6:
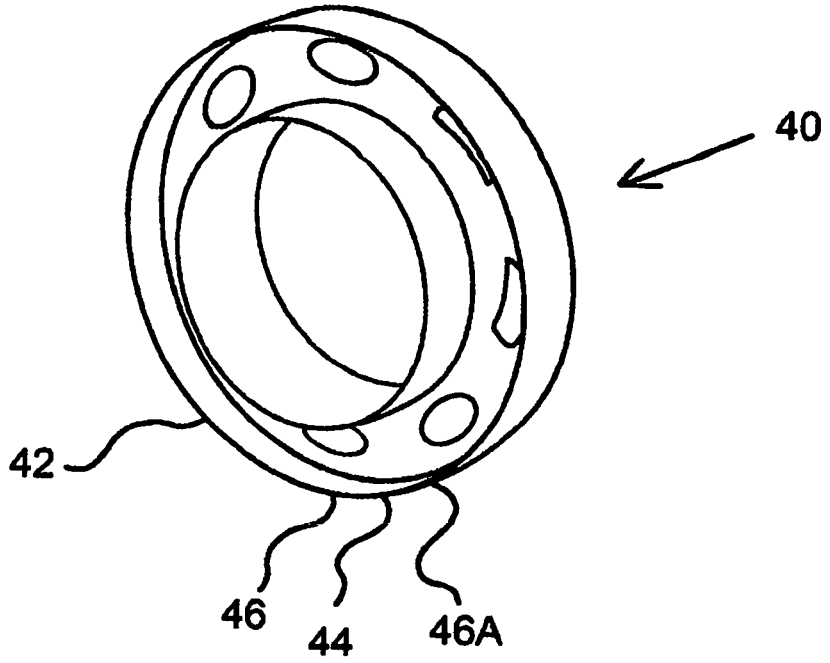
FIG. 6 is a close-up perspective view of the circular duct splicing structure of FIG. 1.
Figure 8:
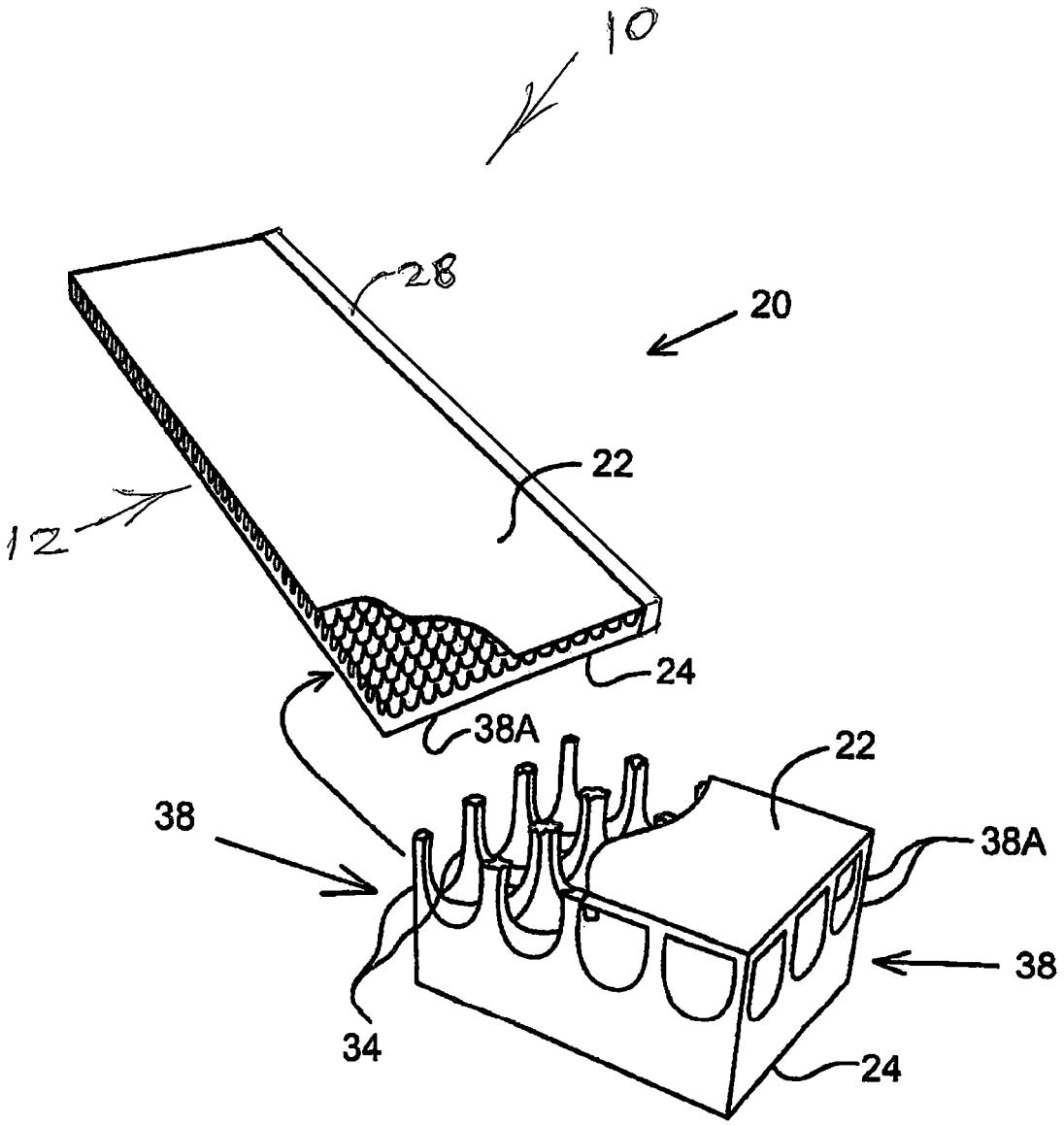
FIG. 8 is a perspective view of a system panel and of a section preferred sheet interconnecting structure which leaves an air gap defining part of a system passageway, where the system includes more than one such system panel interconnected by panel splicing structures.
Figure 9:
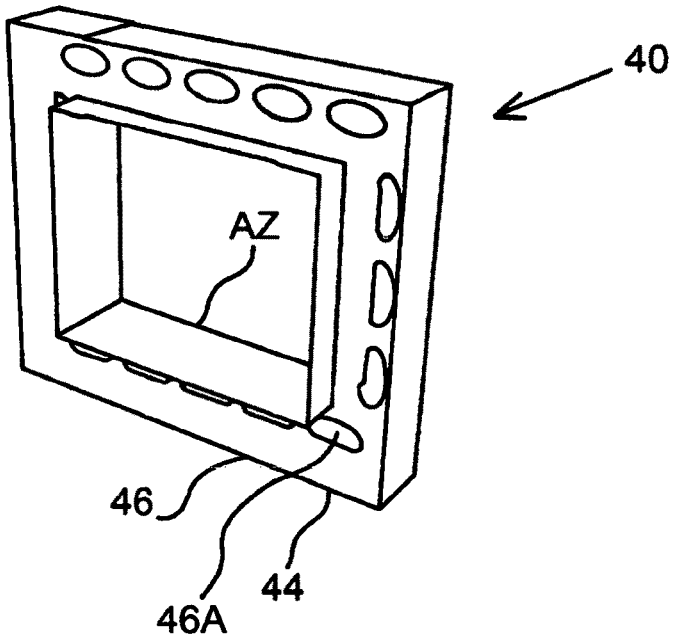
FIG. 9 is a close-up perspective view of the square duct splicing structure, similar to the circular duct splicing structure of FIG. 6.
Figure 10:
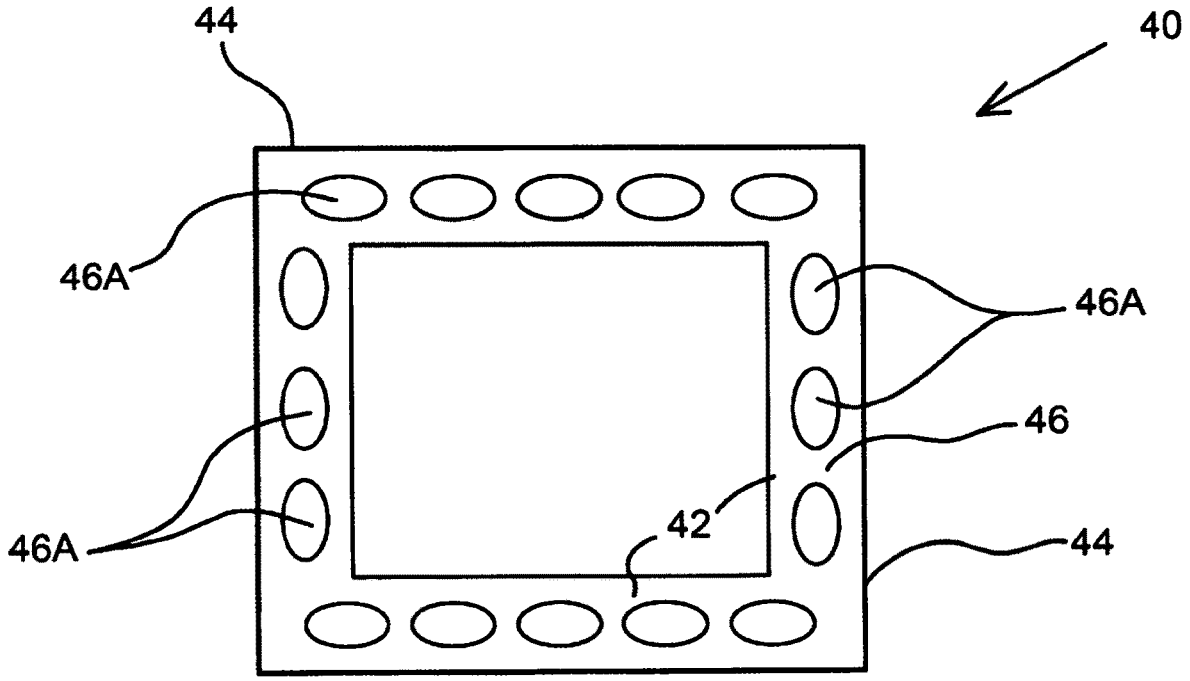
FIG. 10 is a plan end view of the square duct splicing structure of FIG. 9.
Figure 11:
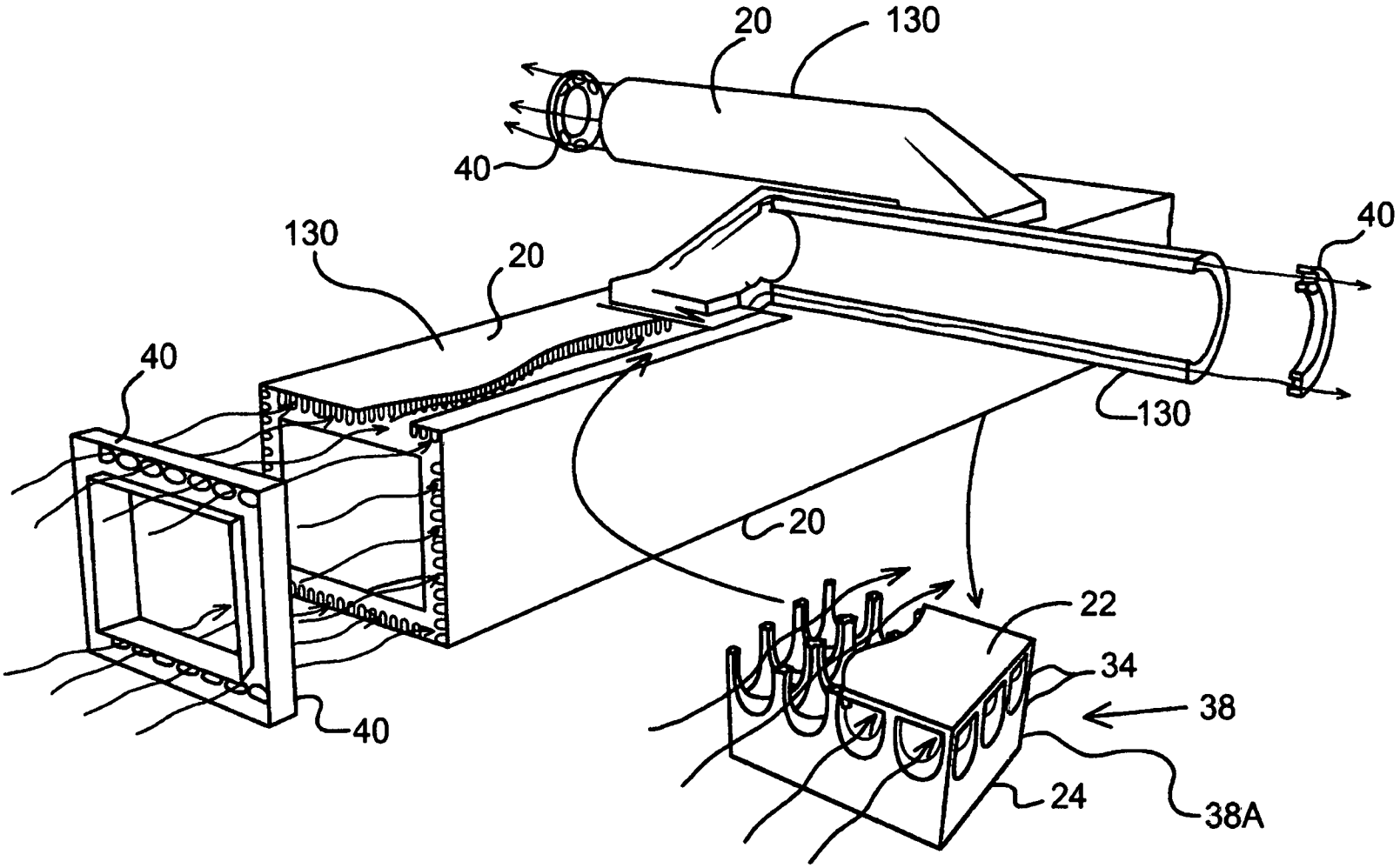
FIG. 11 is a perspective view of a main square system duct formed according to the present building panel system of a system panel looped into a square tubular configuration, having coaxial interior and exterior square tubes sized in diameter to have a heat insulating air gap between them and tube interconnection structures, and a duct splicing structure for connecting one such tube to another end similar to the circular version of FIG. 1, and of two circular system ducts branching from and in fluid communication with the main square system duct.

Other building structures such as walls and partitions normally require system panels 20 that are planar. A preferred interconnecting structure 30 for such panels 20, as shown in FIG. 3, has connecting legs 36 protruding outwardly from one panel sheet 22 and meeting and being connected to the other panel sheet 24, so that gas can flow through lateral spaces between connecting legs 34. The legs 34 preferably protrude from a grid 38 of crossing and interconnected grid flanges 38A, such as of the illustrated egg crate design, to add structural strength to the panel 20. FIG. 8 shows smaller round cross-section take off duct 130 segments branching from a square cross-section main duct 130.

One building structure typically requiring planar system panels 20 is a foundation insulation wall portion abutting a structural wall portion. The series of panels 20 is affixed along the outer surface of the foundation structural wall portion, below ground level, and gas release structures in the form of nozzles 26 protrude upwardly from the upper edges of the series of system panels 20. Fire retardant, again preferably in the form of carbon dioxide gas, is delivered into the system passageway 12 such as from a gas cylinder GC as illustrated, although other dry chemicals may be used for this purpose. The nozzles 26 preferably direct the gas upwardly close to and generally parallel to the outer face of the above ground building wall W. See FIG. 6. The panel splicing structures 40 for planar system panels 20 preferably are plastic I-beams having opposing and spaced apart gripping flanges 42 and 44 to slide snugly over outward surfaces of panel sheets 22 and 24, respectively, and a connecting flange 46 with a series of gaseous substance passing holes 46A.

Figure 7:
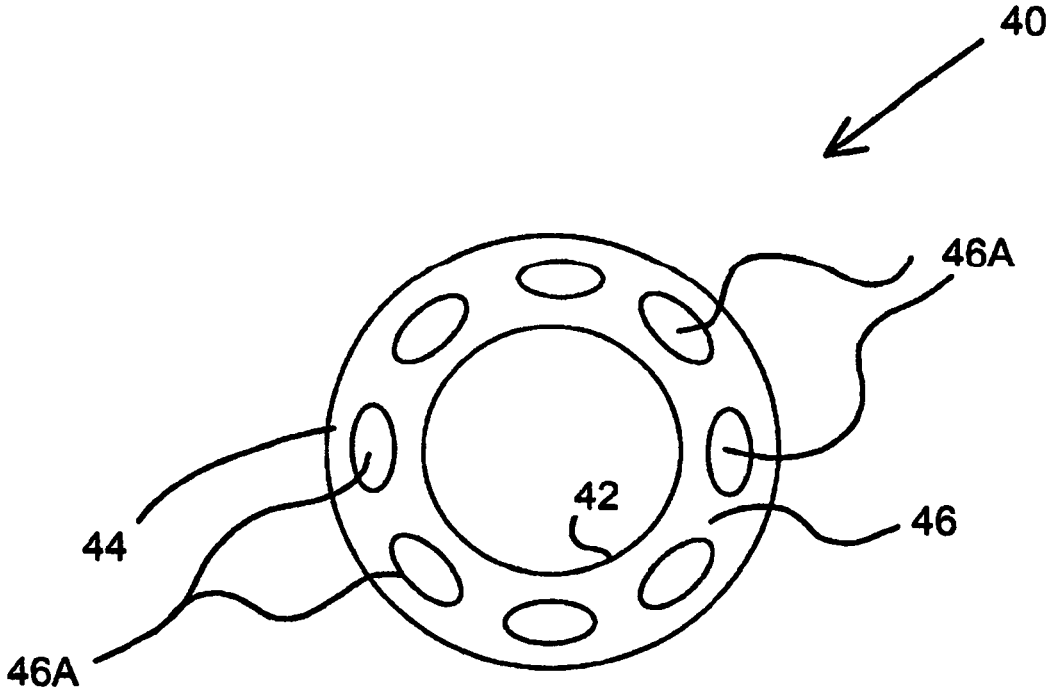
FIG. 7 is a plan end view of the duct splicing structure of FIG. 6.

The plastic sheets 22 and 24 forming the system panels also function as a barrier to the entry of insects by providing a plastic encased building B, such as the home illustrated in FIG. 7.

Panels 20 also may be used to construct wall portions of a variety of alternative products, as illustrated in the FIGURES attached and identified collectively as Alternative Products. These products include but are not limited to storage sheds, shower stalls, heat insulated boxes such as for preserving food and coffins, as illustrated.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A building panel system for constructing internal and external building structures and providing heat insulation and defining a continuous internal flow path for fire retardant, comprising:

a plurality of panels, each said panel comprising a first panel sheet and a second panel sheet generally parallel to and spaced apart from said first panel sheet defining a panel interior in the form of a panel internal gap and a sheet interconnecting structure extending between and structurally joining together said first panel sheet and said second panel sheet;

a gas contained within and substantially filling said panel internal gaps of a plurality of said panels, wherein said gas is one of air and a first retardant gas;

and a plurality of panel splicing structures, each said splicing structure being perforated for passing gaseous fire retardant from the panel interior of one said panel to the interior of an adjacent said panel, such that all parts of said system are in fluid communication with each other and collectively define a system passageway;

such that said panel internal gap between said first panel sheet and said second panel sheet provides a layer of air within each such panel for heat insulation, and said system passageway defined by fluid communication through interconnected panel internal gaps permits a selected fire retardant gas to be delivered into at least one system passageway entry point to flow throughout said system.

2. The building panel system of claim 1, additionally comprising a panel peripheral strip along the upper and lower ends of said system panels to contain gas flowing through said system passageway.

3. The building panel system of claim 1, wherein said panel sheets and said panel splicing structures are formed of ABS plastic.

4. The building panel system of claim 1, additionally comprising a plurality of gas release structures along at least one of said panels and in fluid communication with said system passageway, so that as gas enters the system passageway the gas builds pressure and is discharged through the gas release structures over a target area.

5. The building panel system of claim 4, wherein said gas release structures are one of ports and nozzles.

6. The building system of claim 1, wherein said panel system forms a duct, a first panel sheet being looped to form a duct interior tube having a duct interior tube inward surface and defining a central space within said duct interior tube and a second panel sheet being looped to form a duct exterior tube having a duct exterior tube outward surface containing and generally coaxial with the interior tube and sized relative to the interior tube to be spaced radially apart from the duct interior tube, thereby defining an annular panel internal gap.

7. The building panel system of claim 6, wherein said sheet interconnecting structure comprises a series of radial fins extending between and joined to said duct interior tube and duct exterior tube and extending generally parallel to the substantially common axis of the tubes such that said fins do not obstruct axial gas flow through the annular panel internal gap between the tubes.

8. The building panel system of claim 6, wherein said panel splicing structures each comprise a connecting ring having an outer tube segment sized to slide closely over the duct exterior tube outward surface, and an inner tube segment sized to slide closely over the duct interior tube inward surface, and a perforated tube segment connecting flange extending between and connecting the inner and outer tube segments spaced inwardly from the opposing ends of the tube segments;

such that opposing ends of adjacent duct segments fit snugly into the opposing sides of the connecting ring to interconnect the duct segments;

and such that the central space within the series of duct interior tubes of the resulting duct forms an air conditioning system flow path, while the annular panel internal gap between the collective interior and exterior tubes define at least part of said system passageway.

9. The building panel system of claim 8, additionally comprising a duct transition joint for connecting an end of a square duct to an end of a round duct, said duct transition joint comprising the joint exterior and interior tubes configured such that their cross-sectional shapes progressively change from round to square and said transition joint has a joint square end and a joint round end.

10. The building panel system of claim 7, additionally comprising a duct transition joint for connecting an end of a square duct to an end of a round duct, said duct transition joint comprising the joint exterior and interior tubes configured such that their cross-sectional shapes progressively change from round to square and said transition joint has a joint square end and a joint round end;

wherein each said sheet interconnecting structure comprises a radial connecting flange, set inwardly from either end of said transition joint and having gas passing holes, and the exterior tube is sized to fit closely over the outward surface of the exterior tube of the adjacent one of round and square duct segment, and the interior tube is sized to fit snugly along the inward surface of the interior tube.

11. The building panel system of claim 6, additionally comprising a take-off boot, the flange of which fits snugly inside the inward surface of the interior tube.

12. The building panel system of claim 1, wherein said interconnecting structures each comprise connecting legs protruding outwardly from one said panel sheet and meeting and being connected to the other said panel sheet, such that gas can flow through lateral spaces between connecting legs.

13. The building panel system of claim 12, wherein said legs protrude from a grid of crossing and interconnected grid flanges to add structural strength to the panel.

14. The building panel system of claim 1, wherein said panel splicing structures for planar system panels are plastic I-beams having opposing and spaced apart gripping flanges to slide over outward surfaces of said panel sheets and a connecting flange with a series of gaseous substance passing holes.

* * * * *